US006942172B2

(12) United States Patent
Thomas

(10) Patent No.: US 6,942,172 B2
(45) Date of Patent: Sep. 13, 2005

(54) REEL

(76) Inventor: Steven William Thomas, 16 Stevens Lane, RD 1, Kaukapakapa, Auckland (NZ)

( * ) Notice: Subject to any disclaimer, the term of this patent is extended or adjusted under 35 U.S.C. 154(b) by 0 days.

(21) Appl. No.: 10/654,910

(22) Filed: Sep. 5, 2003

(65) Prior Publication Data

US 2005/0051660 A1 Mar. 10, 2005

(51) Int. Cl.[7] ..... B65H 75/40
(52) U.S. Cl. ..... 242/395; 242/395.1; 242/396.4
(58) Field of Search ..... 242/395, 395.1, 242/396.4

(56) References Cited

U.S. PATENT DOCUMENTS 777,926 A * 12/1904 Stevens ..... 242/396.4
778,045 A * 12/1904 Kirkbride ..... 242/396.4
982,586 A * 1/1911 Gellert ..... 242/395
5,615,844 A * 4/1997 Bosch ..... 242/395
6,134,801 A 10/2000 Miyasaka

FOREIGN PATENT DOCUMENTS

NZ 210340 6/1997
NZ 334535 3/1999

OTHER PUBLICATIONS

Copy of results of search of New Zealand Intellectual Property Office (IPONZ) database, printed May 2002.

* cited by examiner

*Primary Examiner*—Kathy Matecki
*Assistant Examiner*—Sang Kim
(74) *Attorney, Agent, or Firm*—Young & Thompson

(57) ABSTRACT

A reel consists in a drum in use to locate a windable material therearound, a rotatable handle and gearing having a ratio greater than 1:1. The gearing connects the handle with the drum. The gearing includes protruding means which can protrude from the drum or from the gearing. Rotation of the handle drives the protruding means to rotate the drum.

23 Claims, 9 Drawing Sheets

REEL

This invention relates to a reel. The invention is directed particularly, but not solely, toward reels having gearing.

BACKGROUND OF THE INVENTION

To operate most take a significant amount of time and effort as the length of wire that forms the fence is normally extremely long which means a huge effort is required to wind or unwind. This effort is time consuming and tiring.

A further problem with current reels is the heaviness of the reel and wire. Other features such as gearing are used in reels to magnify the effort to wind up or unwind. Gearing normally comprises multiple moving parts which can contribute to excessive maintenance requirements and cost, coupled with significant initial manufacturing costs.

Other uses for reels are for example hose reels, fishing reels, electrical conduit reels, kite reels and weather reels. In general the problems described above are also relevant for reels in general.

It is the object of the present invention to provide an improved reel which will obviate or minimise the aforementioned problems in a simple yet effective manner or which will at least provide the public with a useful choice.

STATEMENT OF INVENTION

Accordingly in a first aspect, the invention provides a reel, the reel includes a drum in use to locate a windable material therearound, a rotatable handle and gearing having a ratio greater than 1:1, the gearing connecting the handle with the drum, the gearing including protruding means, wherein rotation of the handle drives the protruding means to rotate the drum.

Preferably the protruding means protrudes from the drum.

Preferably the protruding means includes at least three elongate members having at least one end fixed to the drum.

Preferably the drum comprises a core member fixedly attached to at least one flange, the core member having a central rotational point, a distal end and a proximal end, the at least one flange having an outer surface facing away from the core member.

Preferably the gearing includes a crank face member operatively connected to the protruding means wherein the crank case member is attached to and facing the flange outer surface.

Preferably the fixed end of each elongate member is located in the side of the at least one flange and the other end of each protruding means is located in the crank face member.

Preferably the crank face member comprises a member having an inner face and an outer face and a rotational centre point, the inner face facing the said at least one flange wherein the inner face includes a track for the sliding location of the said other end of each elongate member.

Preferably the track is provided by three slots crossing the rotational centre and radiating in six equidistant positions (60 degrees) from the rotational centre point of the crank face wherein each slot extends from one circumferential edge to the other.

Preferably during rotation of the handle, each elongate member slidably moves from one end of a pair of slots through the crank face member rotational centre point to the other end of the slot of the coincident pair.

Alternatively the protruding means protrudes from the gearing.

Preferably the gearing includes a crank face member operatively connected to the protruding means wherein the crank case member is attached to and facing the flange outer surface.

Preferably the drum comprises a core member fixedly attached to at least one flange, the core member having a central rotational point, a distal end and a proximal end, the at least one flange having an outer surface facing away from the core member.

Preferably the protruding means includes at least three elongate members having at least one end fixed to the crank.

Preferably the crank face member comprises a member having an inner face and an outer face and a rotational centre point, the inner face facing the said at least one flange wherein the inner face includes the protruding means for the sliding location of the said other end of each elongate member.

Preferably the drum is provided with a track for the sliding location of the said other end of each elongate member.

Preferably the fixed end of each elongate member is located in the side of the crank case member and the other end of each protruding means is located in the drum outer surface.

Preferably the track is provided by three slots crossing the rotational centre and radiating in six equidistant positions (60 degrees) from the rotational centre point of the drum outer surface wherein each slot extends from one circumferential edge to the other.

Preferably during rotation of the handle, each elongate member slidably moves from one end of a pair of slots through the drum flange rotational centre point to the other end of the slot of the coincident pair.

Preferably the reel is provided with a locking mechanism located on the handle.

Preferably the locking mechanism comprises a lever pivotally connected to a pawl member being operatively connected to the handle by a ratchet wherein the handle has the ratchet part thereon.

Preferably a frame has one end connected to the handle and another end connected to the distal end of the core wherein the frame is for holding the crank face member to the core and is for supporting the reel when in use.

Preferably the gearing ratio is 2:1.

DRAWING DESCRIPTION

Preferred forms of the invention will now be described with reference to the accompanying drawings.

DETAILED DESCRIPTION

Figure 1:
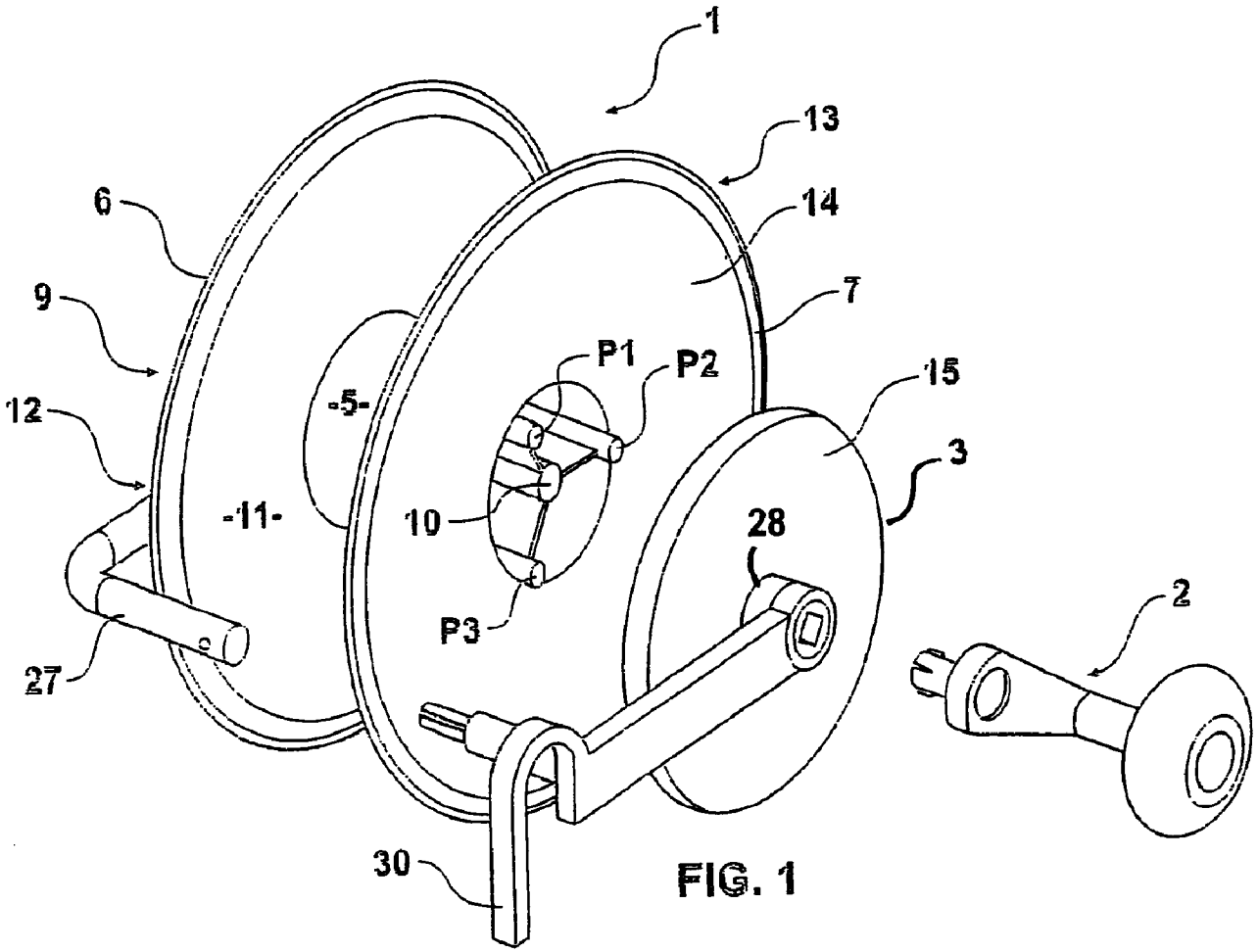
FIG. 1 is a perspective disassembled side view of the reel of the invention.
Figure 2:
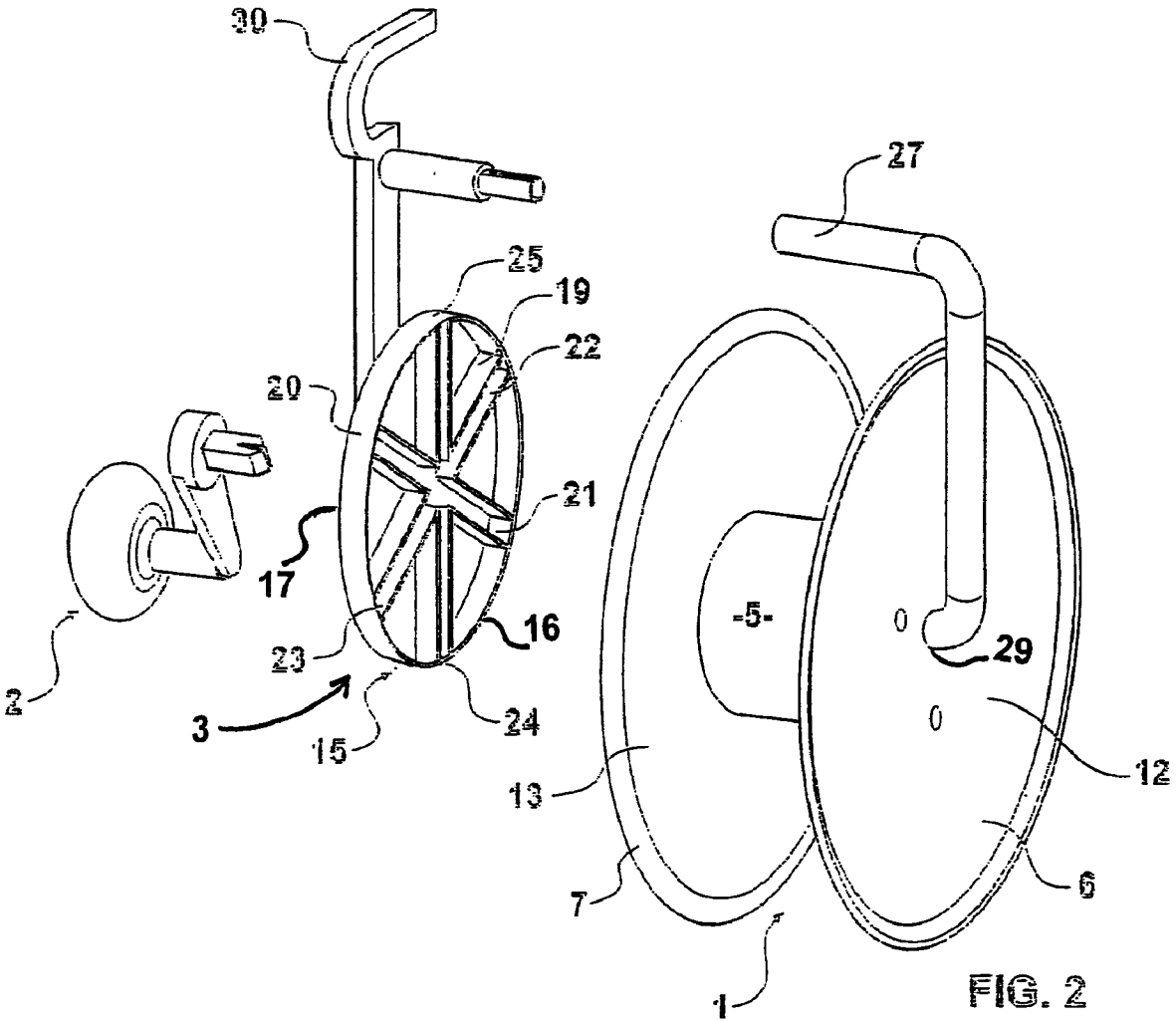
FIG. 2 is an opposite end view of the reel of FIG. 1.
Figure 4:
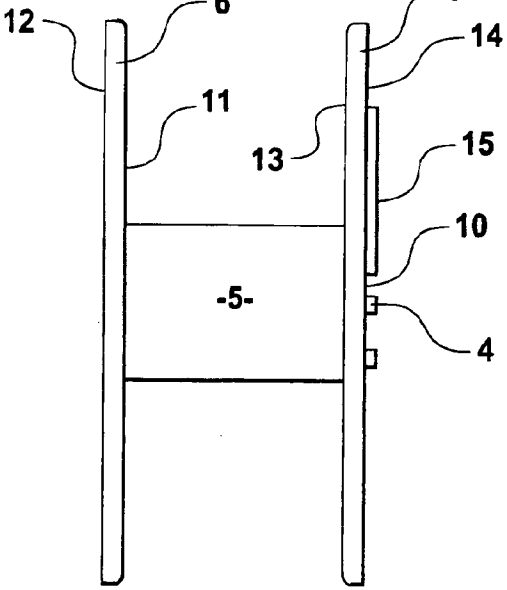
FIG. 4 is a cross sectional view of the reel.
Figure 6:
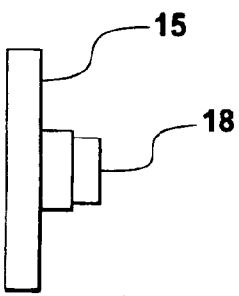
FIG. 6 is a cross sectional view of the crank face member.
Figure 3:
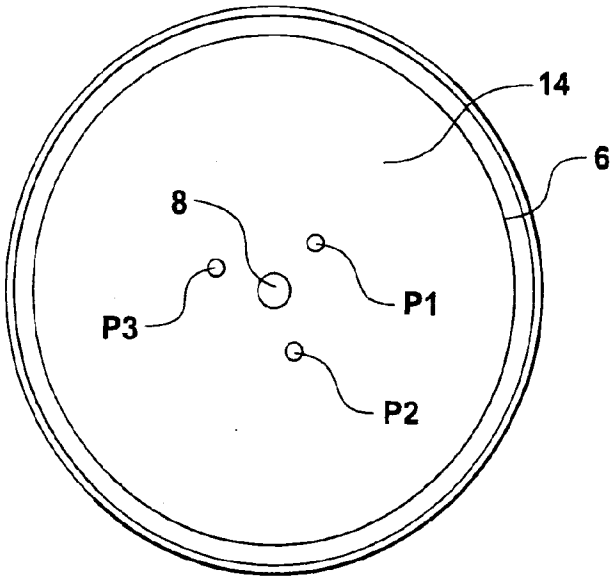
FIG. 3 is a plan view of the flange member.
Figure 5:
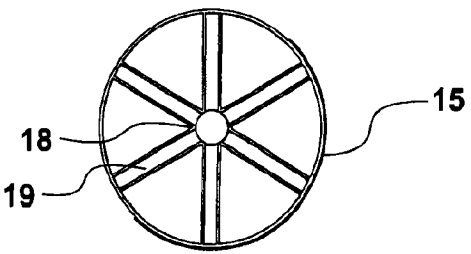
FIG. 5 is a plan view of the crank face member.
Figure 8:
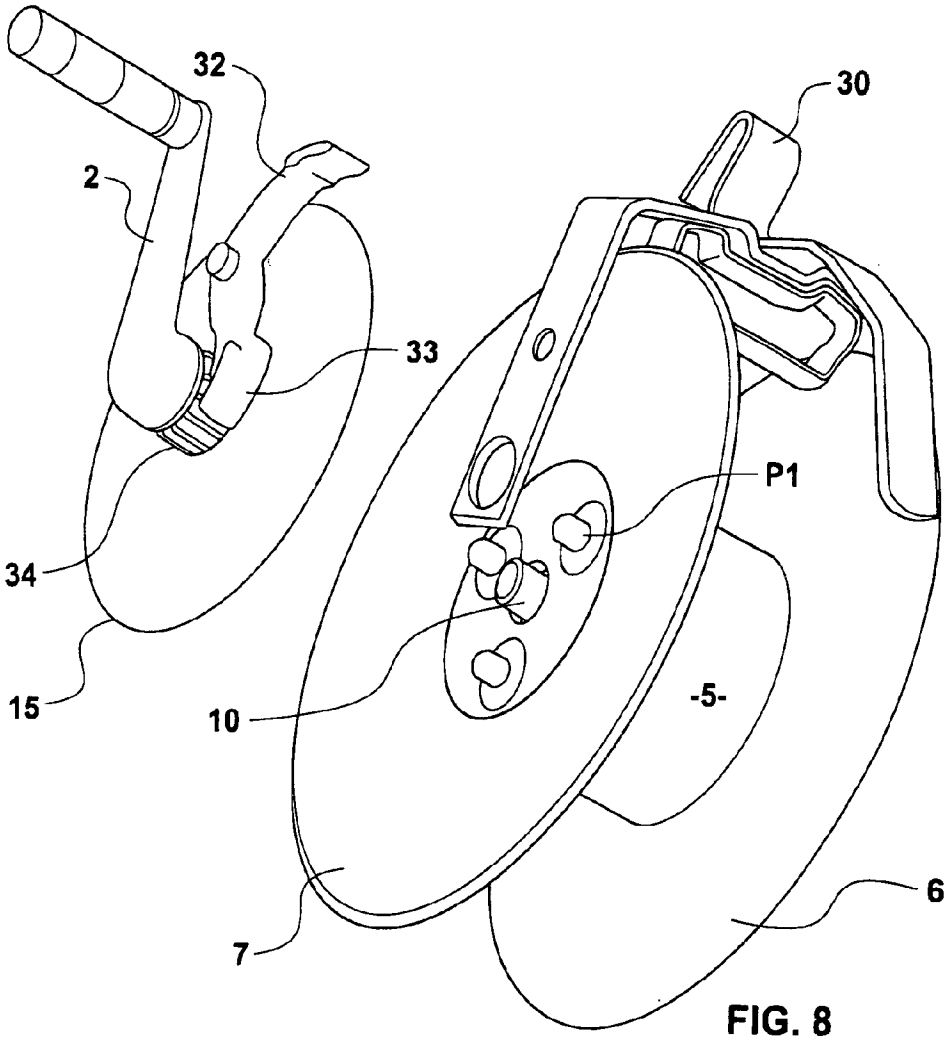
FIG. 8 is a perspective exploded view of another example of the reel.
Figure 7:
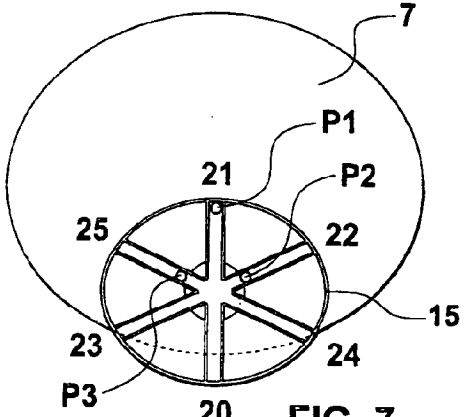
FIG. 7 is a cross section of the pins with respect to the crank face member slots.
Figure 9:
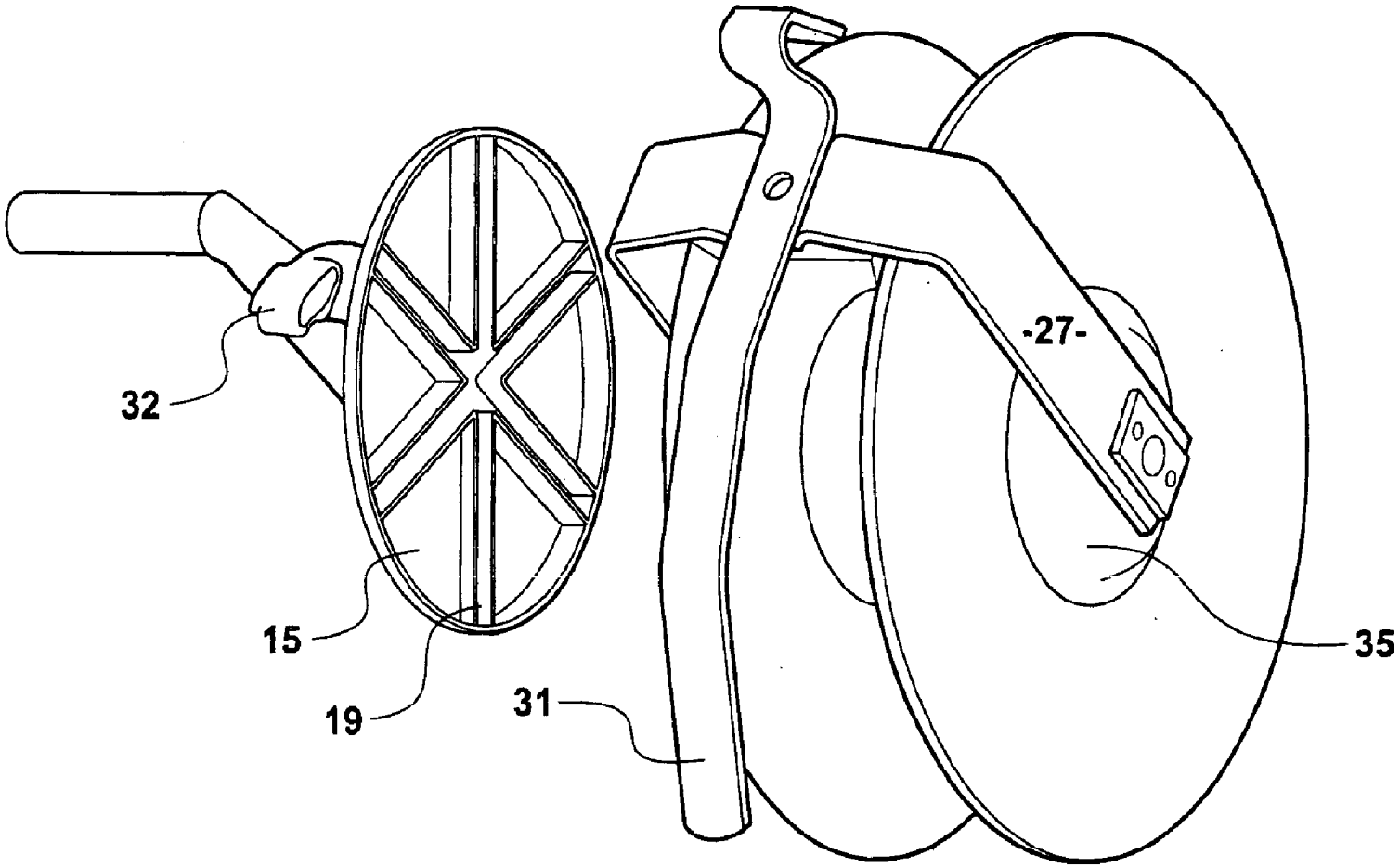
FIG. 9 is another view of the reel of FIG. 8.
Figure 10:
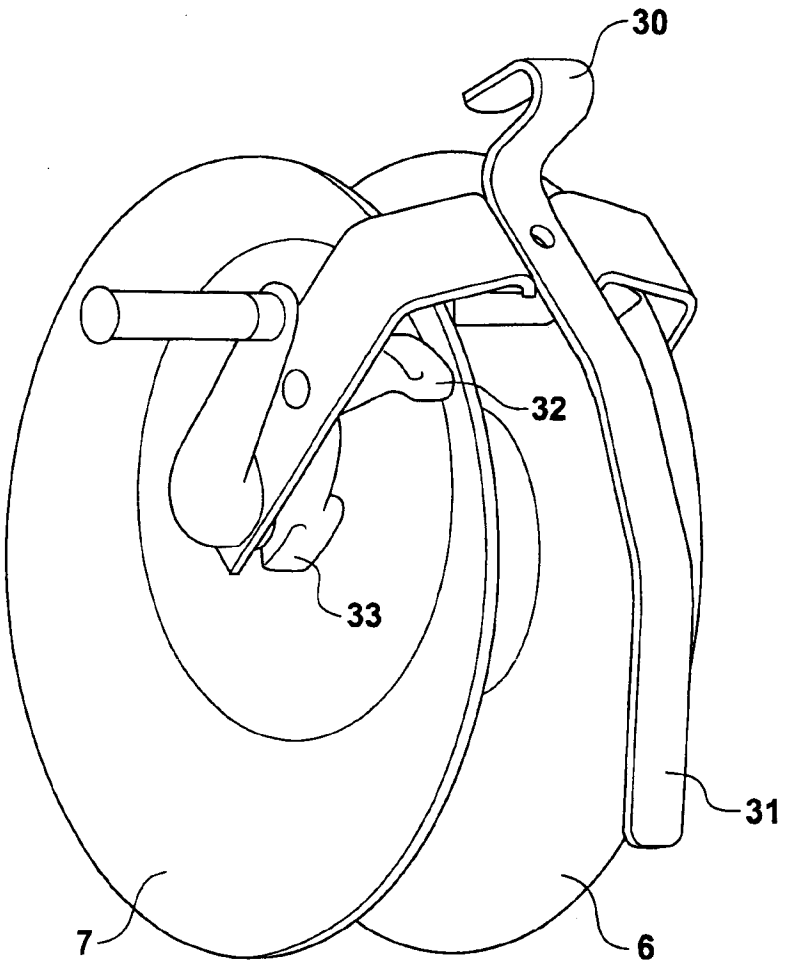
FIG. 10 is an assembled perspective view of the reel of FIGS. 8 and 9.
Figure 11:
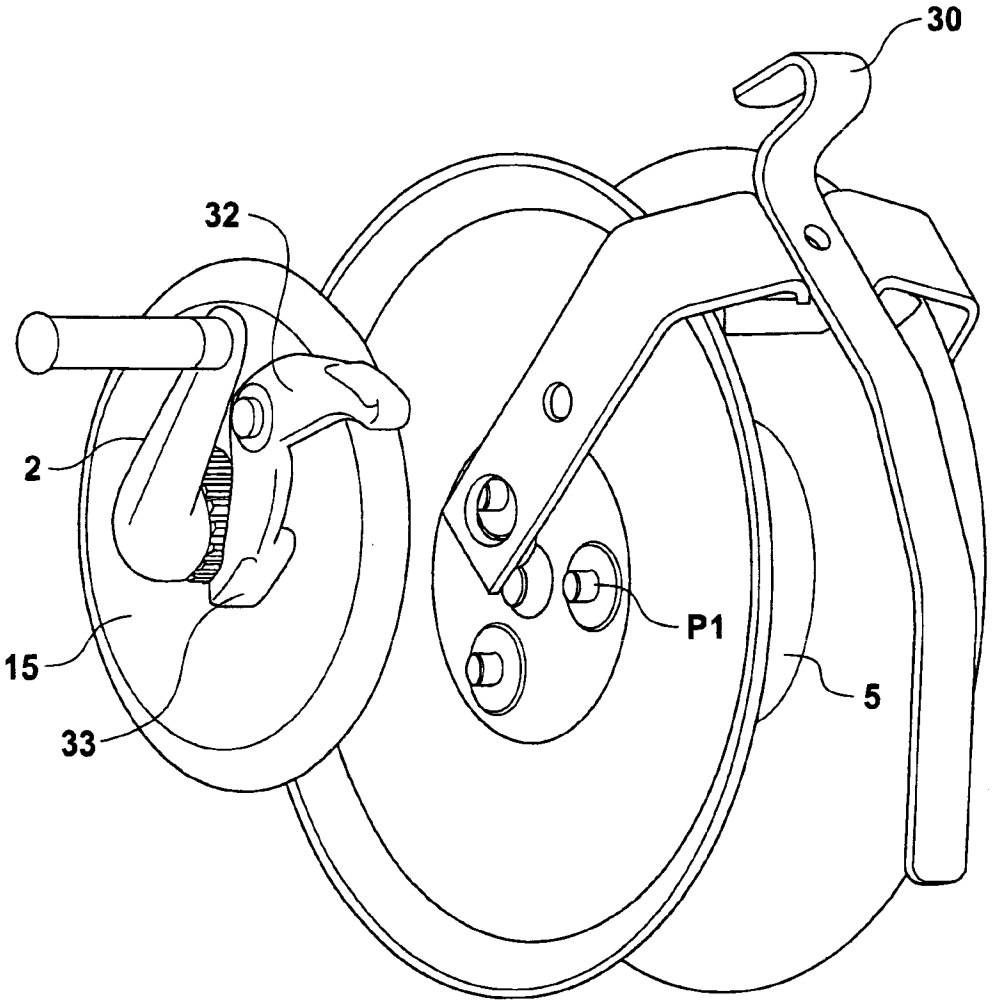
FIG. 11 is an assembled perspective view of the reel having a locking mechanism.
Figure 13:
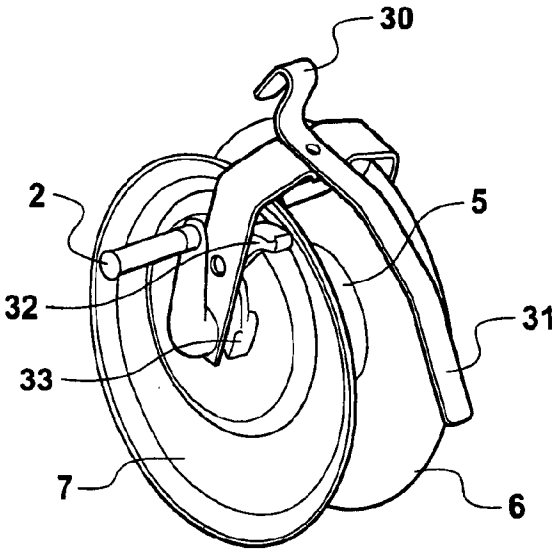
FIG. 13 is a perspective view of the reel of FIG. 12.
Figure 12:
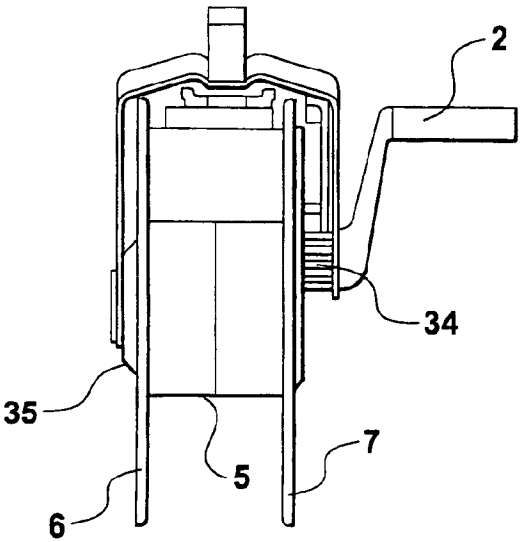
FIG. 12 show the reel having the locking mechanism in another position on the reel.
Figure 14:
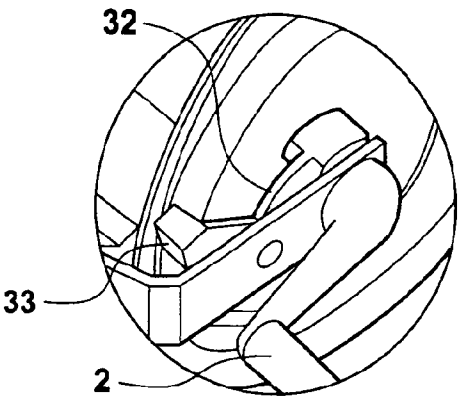
FIG. 14 is a close up perspective of a locking mechanism of FIG. 13.
Figure 16:
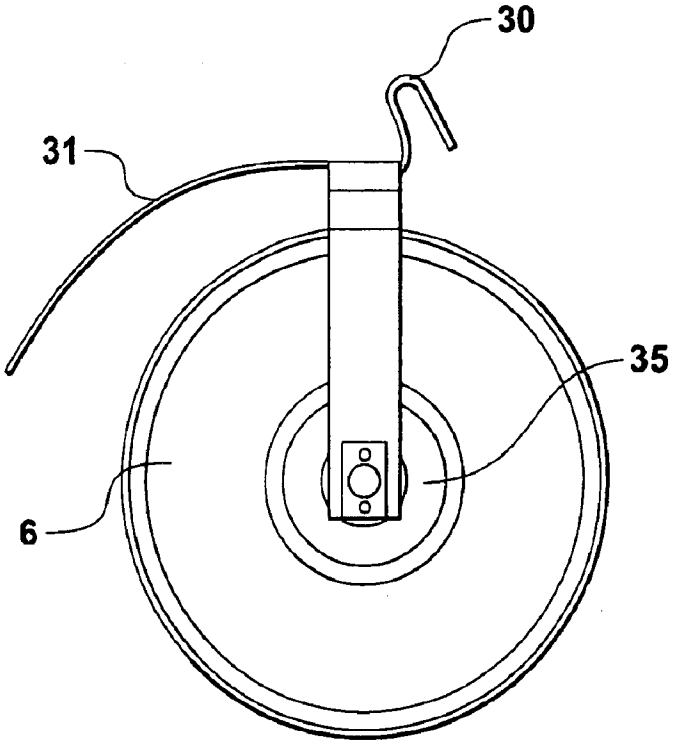
FIGS. 15 and 16 are end views of the reel of FIGS. 12–14.
Figure 15:
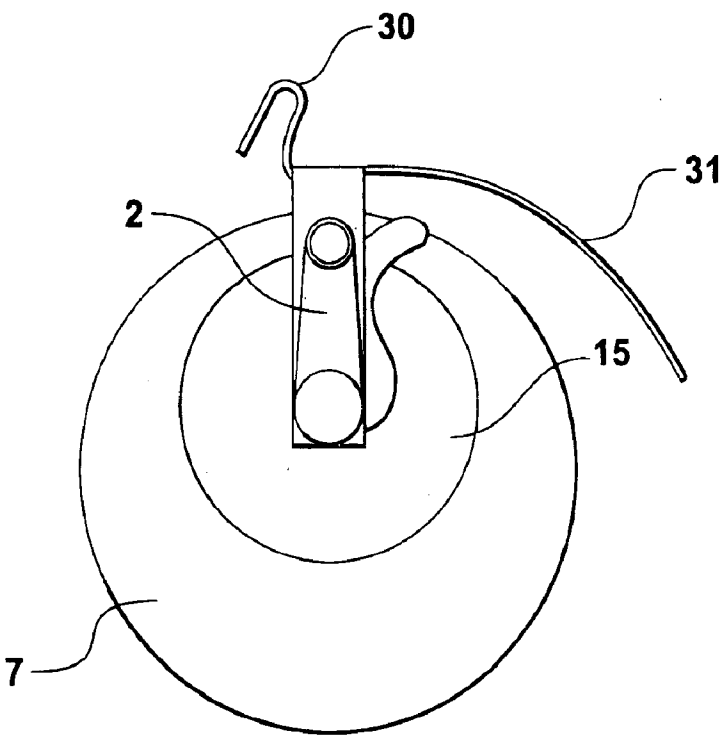

As shown in FIGS. 1 to 16 there are several views of the reel of the invention. The reel includes a drum 1 with an operating handle 2 and gearing 3. The gearing can include protruding means 4 which includes elongate members which may comprise for example metal pins or plastic pins P1, P2, P3 being formed separately or integrally with the drum 1. The gearing ratio can be 2:1 or alternatively 1:2.

The drum 1 includes a core portion 5 and at least one flange 6 or 7. Preferably there are two flanges 6 and 7. The flanges 6 and 7 serve to assist and hold any windable material in place over the core 5. For example the windable material can be fencing wire, hosing, cables, string, rope and fishing lines. The core 5 has a core central rotational axis 8 and a distal end 9 and a proximal end 10. The handle 2 is located on the proximal end of the core 5. The core can be in one piece or several components. For example the core can comprises two interlocking halves.

The flange 6 has an inner surface 11 and an outer surface 12 and the flange 7 has an inner surface 13 and an outer surface 14.

The gearing 3 can also include a crank face member 15 having an inner surface 16 and an outer surface 17. The crank face member 15 has a rotational center or axis 18. Preferably the face member 15 is circular in shape. The crank face member 15 is operatively connected between the handle 2 and one of the flanges 6 or 7. The crank face member 15 has a track 19 located on the inner surface 16 which track operatively allows the protruding means 4 to be inserted therein so that with the rotation of handle 2, the gearing 3 comprising the crank rotates which also rotates the protruding means 4 which in turn turns the reel.

The track 19 can be provided by a slot means or any other shape that allows the protruding means to travel therein. The travel can be a sliding motion. Preferably the slot means consists of three slots made up of six equidistant portions 20 & 21, 22 & 23 and 24 & 25 that radiate from the crack face member rotation axis 18. Each of the three slots is made up of a continuous slot that extends from one circumferential edge of the crank face member to the directly opposing circumferential edge. The six slot portions are substantially equally 60 degrees apart. The first slot is 20 & 21, the second is 22 & 23 and the third slot is 24 & 25.

Therefore for every one complete rotation of the handle 2 we obtain two complete rotations of the core containing the windable material, it is a doubling of the effort put in. During the rotation of the handle 2 the protruding means 4 (for example pins) travel up and down the individual tracks 19. The handle 2 has a point of rotation at the center of the crank face 15 which is off-set from the center of the core 5 thus enabling protruding means 4 which for example can be stainless steel pins to travel in the track 19 and double the effort put in. Therefore for every one complete rotation of the handle and crank face member, each pin simultaneously moves from one end of the paired slots or double track and back. For example at an at rest position (see figure 7) the three pins which are equidistantly fixedly i.e. radially located on core 5 are located on the slots of the crank face member is whereby one pin is at one end of say slot 21 while the other pins are substantially down slots 22 and 25. As the crank face member rotates so the position of the pins with respect to the slots with change.

The reel can also include a frame 27 to enable the reel to be located on any support to enable easy unwinding and winding to occur. The frame 27 also serves to hold the crank face member 15 against the protruding means 4 and flange 7 of the core 5 so that the parts of the reel work together to rotate. The frame 27 can have at least two ends 28 & 29 with one end 28 being located at the handle end of the core i.e. 10 and the other end 29 is located at the distal end of the core at point 8. The frame 27 can also have support means for example at least one hook member 30 to allow location and support during the winding or unwinding operation. Preferably there are at least two hook members 30.

Optionally the hook can be joined to or extend integrally with a protruding portion. Frame 27 can be fabricated from any suitable cross section that enables it to be joined and hold the rest of the assembly together. For example the cross section can be polygonal or rectangular or circular etc.

The reel can be made up of the following material, the core and flanges may be made up of any suitable plastics with the protruding means 4 being made of stainless steel and fixably attached or being integral with the core 5. The crank face member 15 may be a different sort of plastics which enables the protruding means 4 to slide through the track 19. In other examples the handle 2 maybe removable as well as the frame member 27 may also be interchangeable as well.

The reel can also have the protruding means which can act as a holding means 31 whereby the user can grab the holding means which for example can be in the form of a slender member having a gripping portion, while operating the handle 2 or while carrying the reel.

The reel can be provided with a simple locking mechanism as shown in FIGS. 11 to 16. This mechanism can include an outer operating lever 32 pivotally connected to a pawl member 33. The pawl member 33 being connected to a ratchet or teeth 34. The ratchet or teeth 34 being located on the handle 2 or shaft of the handle. The pawl and lever can be one piece or two piece or any number of components necessary to achieve the movement and locking. Other positions for the locking mechanism are also envisaged—see FIGS. 12 to 16. The locking mechanism can be operated by engaging the lever with the pawl when one does not wish the reel to slip.

In another alternative, the protruding means can be located on crank which can be attached to the handle and the slots 19 can be located on the drum. The outer surface of the core member can also be domed 35 to allow for clearance of the frame members from the drum.

The FIGS. 1 to 16 show the reel in one form of operation but this is not limiting one how the reel can be used. The reel as shown can be orientated as shown or it can be reversed depending on the user's preference and the use in which the reel is being used for.

To those skilled in the art to which the invention relates, many changes in construction and widely differing embodiments and applications of the invention will suggest themselves without departing from the scope of the invention as defined in the appended claims. The disclosures and the descriptions herein purely illustrative and are not intended to be in any sense limiting.

Throughout the description and claims of this specification the word "comprise" and variations of that word, such as "comprises" and "comprising", are not intended to exclude other additives, components, integers or steps.

The reel has the following advantages:

1. Few parts.
2. Economic construction.
3. Pleasing appearance.
4. Easy to manufacture.
5. Light weight and tough construction.

I claim:

1. A reel, comprising:

a drum in use to locate a windable material therearound;

a rotatable handle; and gearing having a ratio greater than 1:1, the gearing connecting the handle with the drum, the gearing including protruding means and a track that is perpendicular to an axis of rotation of said drum, said protruding means sliding within said track, wherein rotation of the handle drives the protruding means to rotate the drum.

2. The reel as claimed in claim 1, wherein the protruding means protrudes from the drum.

3. The reel as claimed in claim 2, wherein the protruding means includes at least three elongate members having at least one end fixed to the drum.

4. The reel as claimed in claim 3, wherein the drum comprises a core member fixedly attached to at least one flange, the core member having a central rotational point, a distal end and a proximal end, the at least one flange having an outer surface facing away from the core member wherein the gearing includes a crank face member operatively connected to the protruding means wherein the crank case member is attached to and facing the flange outer surface.

5. The reel as claimed in claim 4, wherein the fixed end of each elongate member is located in the side of the at least one flange and the other end of each protruding means is located in the crank face member.

6. The reel as claimed in claim 5, wherein the crank face member comprises a member having an inner face and an outer face and a rotational center point, the inner face facing said at least one flange wherein the inner face includes said track for the sliding location of another end of each elongate member.

7. The reel as claimed in claim 6, wherein the track is provided by three slots crossing the rotational center point and radiating in six equidistant positions from the rotational center point of the crank face wherein each slot extends from one circumferential edge to another.

8. The reel as claimed in claim 7, wherein during rotation of the handle, each elongate member slidably moves from one end of a pair of slots through the crank face member rotational center point to the other end of the slot of the coincident pair.

9. The reel as claimed in claim 1, wherein the protruding means protrudes from the gearing.

10. The reel as claimed in claim 9, wherein the gearing includes a crank face member operatively connected to the protruding means wherein the crank case member is attached to and facing the flange outer surface.

11. The reel as claimed in claim 10, wherein the drum comprises a core member fixedly attached to at least one flange, the core member having a central rotational point, a distal end and a proximal end, the at least one flange having an outer surface facing away from the core member.

12. The reel as claimed in claim 11, wherein the protruding means includes at least three elongate members having at least one end fixed to the crank.

13. The reel as claimed in claim 12, wherein the crank face member comprises a member having an inner face and an outer face and a rotational center point, the inner face facing the said at least one flange wherein the inner face includes the protruding means for the sliding location of the said other end of each elongate member.

14. The reel as claimed in claim 13, wherein the drum is provided with said track for the sliding location of another end of each elongate member.

15. The reel as claimed in claim 14, wherein the fixed end of each elongate member is located in the side of the crank case member and the other end of each protruding means is located in the drum outer surface.

16. The reel as claimed in claim 15, wherein the track is provided by three slots crossing the rotational center point and radiating in six equidistant positions from the rotational center point of the drum outer surface wherein each slot extends from one circumferential edge to another.

17. The reel as claimed in claim 16, wherein during rotation of the handle, each elongate member slidably moves from one end of a pair of slots through the drum flange rotational center point to the other end of the slot of the coincident pair.

18. The reel as claimed in claim 17, wherein the reel is provided with a locking mechanism located on the handle.

19. The reel as claimed in claim 18, wherein the locking mechanism comprises a lever pivotally connected to a pawl member being operatively connected to the handle by a ratchet wherein the handle has the ratchet part thereon.

20. The reel as claimed in claim 19, wherein a frame has one end connected to the handle and another end connected to the distal end of the core wherein the frame is for holding the crank face member to the core and is for supporting the reel when in use.

21. The reel as claimed in claim 20, wherein the gearing ratio is 2:1.

22. A reel, comprising:

a drum in use to locate a windable material the therearound;

a rotatable handle; and gearing having a ratio greater than 1:1, said gearing connecting said handle with said drum, said gearing including protruding means, wherein rotation of the handle drives the protruding means to rotate the drum, wherein the protruding means includes at least three elongate members having at least one end fixed to said drum, wherein said gearing includes a crank face member operatively connected to the protruding means, wherein said crank face member comprises a member having an inner face and an outer face and a rotational center point, wherein the inner face includes a track for the sliding location of another end of each elongate member, and wherein the track is provided by three slots crossing the rotational center point and radiating in six equidistant positions from the rotational center point each of said three slots extend from one circumferential edge to another.

23. A reel, comprising:

a drum for positioning a windable material therearound;

a rotatable handle; and a gear assembly, said gear assembly connecting said handle with said drum, said gear assembly having a protrusion and a groove, said protrusion being slidable within said groove in a plane perpendicular to an axis of rotation of said drum, so that rotation of said handle causes said protrusion to rotate said drum.

* * * * *